United States Patent [19]

Brussee et al.

[11] Patent Number: 4,514,780

[45] Date of Patent: Apr. 30, 1985

[54] DISCHARGE ELECTRODE ASSEMBLY FOR ELECTROSTATIC PRECIPITATORS

[75] Inventors: Richard C. Brussee, Euclid; Robert E. Dowd, Jr., Kirtland, both of Ohio

[73] Assignee: Wm. Neundorfer & Co., Inc., Cleveland, Ohio

[21] Appl. No.: 456,482

[22] Filed: Jan. 7, 1983

[51] Int. Cl.[3] ..... B03C 3/41

[52] U.S. Cl. ..... 361/226; 55/147; 55/151; 55/153; 361/230

[58] Field of Search ..... 55/147, 150, 151, 153; 361/226, 229, 230, 220; 313/269, 278; 339/101

[56] References Cited

U.S. PATENT DOCUMENTS 3,483,670 12/1969 Quintilian et al. ..... 55/147 X
3,706,900 12/1972 Van Beek ..... 313/269 X

FOREIGN PATENT DOCUMENTS 503495 7/1930 Fed. Rep. of Germany ..... 55/151
537932 11/1931 Fed. Rep. of Germany ..... 339/101

*Primary Examiner*—Harry E. Moose, Jr.
*Attorney, Agent, or Firm*—Antonelli, Terry & Wands

[57] ABSTRACT

An improved high-voltage discharge electrode assembly for an electrostatic precipitator is disclosed. The discharge electrode assembly comprises, in combination, an elongated discharge electrode, an anchoring element, one end of the elongated discharge electrode being secured at the anchoring element, and a flexible shroud closely surrounding the elongated discharge electrode adjacent the anchoring element whereby the life of the electrode in the electrostatic precipitator is extended. In a preferred form, the flexible shroud is a closely coiled, cylindrical helical spring.

15 Claims, 6 Drawing Figures

FIG. 4.
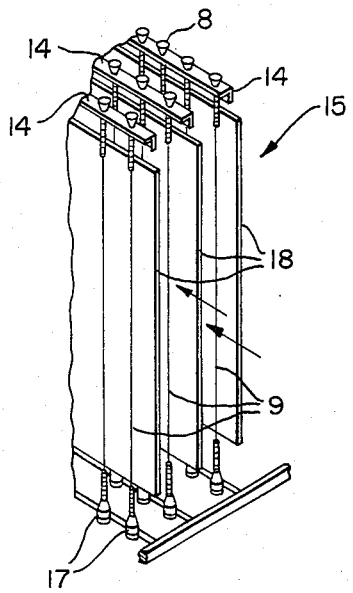
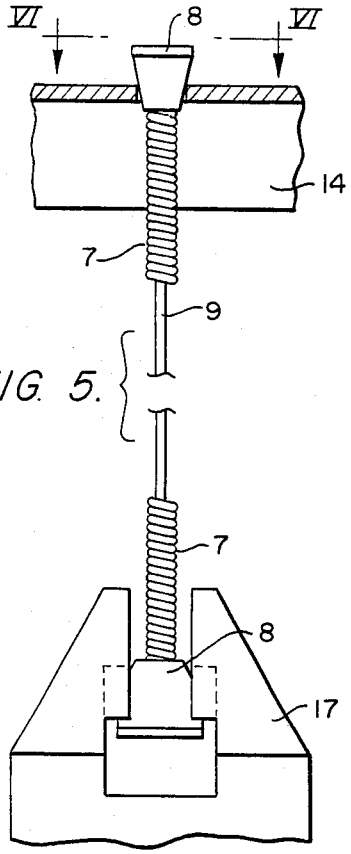
FIG. 5.
FIG. 6.
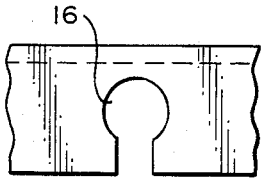

DISCHARGE ELECTRODE ASSEMBLY FOR ELECTROSTATIC PRECIPITATORS

BACKGROUND AND SUMMARY OF THE INVENTION

This invention relates generally to gas separation devices such as electrostatic precipitators and more particularly to an improved high-voltage discharge electrode assembly for extending the life of the discharge electrodes therein.

Electrostatic precipitators are used to remove foreign particles from a gas stream. They typically include a plurality of grounded collecting electrodes and high-voltage discharge electrodes suspended in spaced relationship to each other from supporting structure in precipitator shell.

The foreign particles in a gas stream moving between the electrodes of an electrostatic precipitator become negatively charged as a result of a high potential field set up between the collecting and discharge electrodes and are attracted to the grounded collecting electrode upon which they accumulate. A few of the particles may be attracted to the discharge electrodes and accumulate there. The accumulations on the electrodes are jarred loose by means of rappers or vibrators such as those shown in U.S. Pat. Nos. 2,922,085; 3,030,753; and 3,731,907.

The collecting electrodes are usually constructed of flat metal plates suitably connected together, whereas the discharge electrodes take the form of elongated wires, ribbons or rods suspended from the support structure. One means of suspending the discharge electrodes from the support structure has been to provide a shroud formed of a rigid piece of bar stock at the end of the discharge electrode as shown in FIG. 1 of the drawings. The discharge electrode is received within a hole in the end of the shroud and is retained therein by crimping or swaging the surrounding end of the shroud. While this known arrangement is relatively simple and economical to manufacture, it is disadvantageous in that it creates a stress point at the connection between the discharge electrode and the shroud which is subject to fatigue and mechanical failure from the rapping or vibrating of the electrodes. An area susceptible to corona discharge is also created in such an assembly.

There have been several attempts to avoid these problems associated with the type of discharge electode assembly illustrated in FIG. 1. For example, in U.S. Pat. No. 2,867,287 a discharge electrode construction is disclosed wherein each end of the discharge electrode is integrally formed into a spiral or coil spring section which, in turn, is received in a rigid tubular shroud member which may be attached to the precipitator support frame or from which a weight may be suspended. However, with such an arrangement the spring sections of the discharge electrode are normally under considerable tension because of the weight suspended from the lower end of the electrode. As a result of this tension and the relatively high temperatures in the electrostatic precipitators in which these discharge electrodes may be used, the coiled sections of the discharge electrode may lose their spring properties over time thereby increasing the likelihood of breakage of the electrodes.

More recently, a discharge electrode assembly for electrostatic precipitators was disclosed in U.S. Pat. No. 3,483,670 and employs a rigid shroud at each end of the discharge electrode. The shrouds are crimped upon the electrode wire to provide a mechanical connection which grips the electrode with graduated or tapering forces along the length of the crimp so as to reduce the severe localized stresses at the point of connection. That is, the crimped connections spread or distribute the stress through a much larger area so as to provide a longer service life for the electrode. However, with this known discharge electrode assembly breakage of the discharge electrode adjacent the crimped connection with the rigid shroud can still occur.

An object of the present invention is to provide an improved high-voltage discharge electrode assembly which extends the life of the electrode in an electrostatic precipitator as compared with the known arrangements wherein a rigid shroud is crimped to the electrode wire creating a stess point at the point of connection between the wire and the shroud which is subject to fatigue and mechanical failure.

A further object of the invention is to provide an improved high-voltage discharge electrode assembly which is simple and economical to manufacture and which retains its effectiveness in resisting breakage of the electrode from fatigue and mechanical failure even after considerable periods of operation in an electrostatic precipitator.

These and other objects are attained according to the invention by providing a high-voltage discharge electrode assembly for an electrostatic precipitator which comprises, in combination, an elongated discharge electrode, an anchoring element, one end of the elongated discharge electrode being secured at the anchoring element, and a flexible shroud member closely surrounding the elongated discharge electrode adjacent the anchoring element, whereby the life of the electrode in the electrostatic precipitator is extended.

In a disclosed, preferred embodiment the flexible shroud member comprises a spring which closely surrounds the elongated discharge electrode adjacent the anchoring element. The spring is a closely coiled, cylindrical helical spring.

According to an additional feature of the invention the flexible shroud member is secured to the elongated discharge electrode adjacent the anchoring element by a crimped portion of the flexible resilient shroud member which engages the electrode.

The end of the elongated discharge electrode secured at the anchoring element extends through a bore in the anchoring element and is formed with an enlarged, headed portion which secures the end of the electrode against axial displacement through the anchoring element. The anchoring element is in the form of a button with an outwardly tapered lower surface which may be received in an open keyhole slot in the support frame of an electrostatic precipitator for a suspending the discharge electrode from the support frame.

In the disclosed embodiment like assemblies are provided at each end of the discharge electrode. The anchoring element of the upper assembly is used to suspend the electrode from the support frame of an electrostatic precipitator. A weight is suspended from the lower anchoring element.

These and other objects, features and advantages of the present invention will become more apparent from the following description when taken in connection with the accompanying drawings, which show, for purposes of illustration only, one embodiment in accordance with the present invention.

BRIEF DESCRIPTION OF THE DRAWINGS

FIG. 4 is an isometric view of a portion of complementary discharge and collecting electrode structures of an electrostatic precipitator with high-voltage discharge electrode assemblies embodying the discharge electrode assembly of the present invention;

FIG. 5 is an enlarged front elevation, partly in cross section, of one of the discharge electrode assemblies of FIG. 4; and FIG. 6 is a top view of a part of the discharge electrode support frame taken along the line VI—VI of FIG. 5.

DETAILED DESCRIPTION OF THE PREFERRED EMBODIMENT

Figure 1:
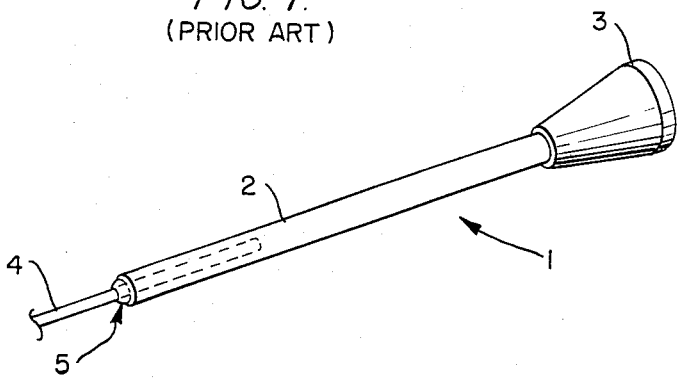
FIG. 1. (PRIOR ART)
FIG. 1 is a perspective view from the front and to one side of a prior art high-voltage discharge electrode assembly.

Referring now to the drawings, FIG. 1 illustrates a prior art high-voltage discharge electrode assembly 1 which comprises a shroud 2 formed of a rigid piece of bar stock, an anchoring element 3 in the form of a button connected at one end of the shroud 2, and a discharge electrode wire 4 received within a bore at the other end of the shroud 2 and attached thereto by crimping or swaging the shroud 2 on the wire 4. This known high-voltage discharge electrode assembly is disadvantageous in that a stress point 5 is created at the point of connection between the electrode wire 4 and the shroud 2 which is subject to fatigue and mechanical failure by the rapping or vibrating of the electrodes to remove particles collected thereon. In this known arrangement an area is also created which is susceptible to corona discharge. Because of this, it is very common for electrode wires 4 to break at the stress point 5.

Figure 2:
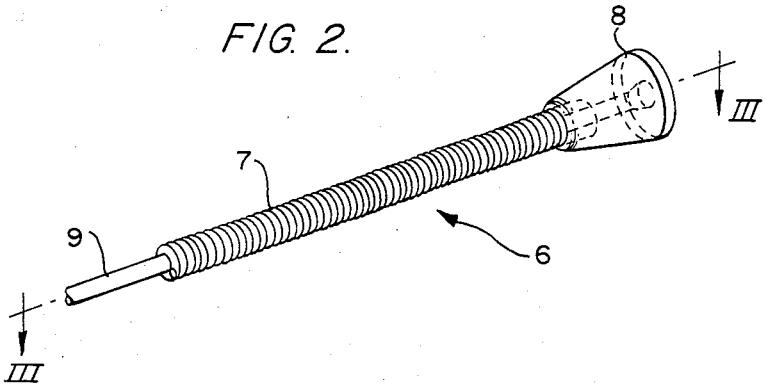
FIG. 2 is a perspective view from the front and to one side of a high-voltage discharge electrode assembly according to the present invention.
Figure 3:
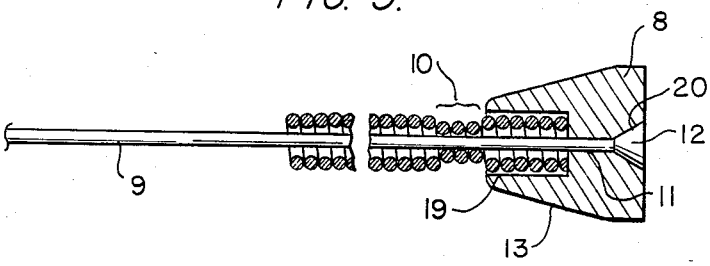
FIG. 3 is an enlarged side view, partially in cross section, of the high-voltage discharge electrode assembly of FIG. 2.

The disclosed, preferred embodiment of the improved high-voltage discharge electrode assembly of the invention illustrated in FIGS. 2 and 3 of the drawings eliminates the stress point 5 between the electrode and the shroud and extends the life of the discharge electrode in an electrostatic precipitator by providing that the end of the discharge electrode 9 is received through a flexible shroud 7 in the form of a tightly wound spring and is secured at an anchoring element 8 which is adjacent the end of the spring. In this manner, the stress point between the electrode and shroud is eliminated and the shroud provides flexibility to the electrode, thus reducing the breakage of the same. That is, the spring yieldably limits the flexing (hence stressing) which can take place during rapping or vibrating and this yieldable resistance to stressing is distributed over the length of the flexible shroud.

The flexible shroud 7 is a closely coiled, cylindrical helical spring which closely surrounds the elongated discharge electrode 9 adjacent the anchoring element 8. One end of the flexible shroud 7 extends into a recess 19 in the anchoring element. The shroud 7 is secured to the discharge electrode 9 by a crimped portion 10 of the shroud which engages the electrode adjacent the anchoring element. A conventional spring steel is used to form the flexible shroud 7. In the illustrated embodiment, the spring steel has a circular cross section and is 12 gauge spring steel having a diameter of 0.1055 inch. The shroud 7 is approximately two and one-half inches long in the illustrated embodiment but the length thereof may vary.

The anchoring element 8 is in the form of a button and has a central bore 11 coaxial with recess 19 extending axially therethrough as shown in FIG. 3. The discharge electrode 9 is a wire having a circular cross section with one end thereof extending through the bore 11 and being formed with an enlarged, headed portion 12 which is received in an enlarged portion 20 of the bore 11 to secure the one end of the electrode against axial displacement through the anchoring element. The enlarged portion 12 on the discharge electrode wire 9 is formed by heating and flattening the one end of the wire in a heading process after it has been passed through the bore 11.

The closely coiled, cylindrical helical spring of the flexible shroud 7 is preferably formed with an inside diameter which is slightly greater, for example 0.010 inch greater, than the outside diameter of the discharge electrode so that the electrode can be passed therethrough as a preliminary step to placing the end of the discharge electrode through the bore 11 of the anchoring element 8 and forming the enlarged, headed portion 12 thereon. After the flexible shroud 7 has been placed over the discharge electrode 9, the portion 10 of the shroud 7 is crimped into engagement with the discharge electrode thereby securing the flexible shroud 7 to the discharge electrode adjacent the anchoring element 8.

The anchoring element 8 is formed with an outwardly tapered lower surface 13 for suspending the discharge electrode assembly 6 from a high-voltage support frame 14 of an electrostatic precipitator 15 shown in part in FIG. 4. Each discharge electrode assembly 6 is arranged in a keyhole shaped opening 16 in the support frame 14 so that there is line contact between the high-voltage support frame and the tapered lower surface 13 of the anchoring element 8. In the illustrated embodiment, each end of the discharge electrode wire 9 is provided with an anchoring element and a flexible shroud of the type illustrated in FIGS. 2 and 3. A weight 17 is suspended from the anchoring element at the lower end of each discharge electrode for tensioning the electrode assembly and aligning it vertically between the spaced collector electrodes 18 defining a gas passage through the electrostatic precipitator 15.

A rapper or vibrator, not shown, is attached to the collecting and discharge electrode support structure in a manner well known in the art to remove the particles collected thereon by vibrating the electrodes to loosen the accumulated particles thereon. The loosened particles fall downwardly of their own weight into suitable collecting means. By using the improved discharge electrode assembly of the invention in such arrangement, the problems of fatigue and mechanical failure between the discharge electrode and shroud encountered with the above-discussed prior art arrangement are reduced or eliminated and the life of the discharge electrode is extended.

While we have shown and described only one embodiment in accordance with the invention, it is understood that the same is not limited thereto but is susceptible of numerous changes and modifications as known to those skilled in the art. For example, instead of crimping the flexible shroud on the discharge electrode the shroud could be welded to the anchoring element to secure it in position. Further, the material of the flexible shroud need not be circular in cross section but may have a square or other cross sectional configuration. We therefore do not wish to be limited to the details shown and described herein but intended to cover all such changes and modifications as are encompassed by the scope of the appended claims.

We claim:

1. A high-voltage discharge electrode assembly for an electrostatic precipitator comprising, in combination, an elongated discharge electrode, an anchoring element, one end of said elongated discharge electrode being secured at said anchoring element, and a flexible shroud as an attachment over said elongated high-voltage discharge electrode which closely surrounds said elongated discharge electrode adjacent said anchoring element, whereby the life of said electrode in said electrostatic precipitator is extended.

2. A high-voltage discharge electrode assembly according to claim 1, wherein said flexible shroud comprises a spring which closely surrounds said elongated discharge electrode adjacent said anchoring element.

3. A high-voltage discharge electrode assembly according to claim 2, wherein said spring is a closely coiled, cylindrical helical spring.

4. A high-voltage discharge electrode assembly according to claim 1, wherein said flexible shroud is secured to said elongated discharge electrode adjacent said anchoring element by a crimped portion of said flexible shroud which engages said electrode.

5. A high-voltage discharge electrode assembly according to claim 1, wherein said elongated discharge electrode is a wire.

6. A high-voltage discharge electrode assembly for an electrostatic precipitator comprising, in combination, an elongated discharge electrode, an anchoring element, one end of said elongated discharge electrode being secured at said anchoring element, and a flexible shroud closely surrounding said elongated discharge electrode adjacent said anchoring element, whereby the life of said electrode in said electrostatic precipitator is extended, and wherein said one end of the elongated discharge electrode secured at said anchoring element extends through a bore in said anchoring element and is formed with an enlarged, headed portion which secures said one end of the electrode against axial displacement through the anchoring element.

7. A high-voltage discharge electrode assembly for an electrostatic precipitator comprising, in combination, an elongated discharge electrode, an anchoring element, one end of said elongated discharge electrode being secured at said anchoring element, and a flexible shroud closely surrounding said elongated discharge electrode adjacent said anchoring element, whereby the life of said electrode in said electrostatic precipitator is extended, and wherein said anchoring element is in the form of a button with an outwardly tapered lower surface.

8. A high-voltage discharge electrode assembly according to claim 1, wherein the second end of said discharge electrode is also secured at an additional anchoring element with an additional flexible shroud being provided to closely surround said elongated discharge electrode adjacent said additional anchoring element.

9. A high-voltage discharge electrode assembly for an electrostatic precipitator comprising, in combination, an elongated discharge electrode, an anchoring element, one end of said elongated discharge electrode being secured at said anchoring element, and a flexible shroud closely surrounding said elongated discharge electrode adjacent said anchoring element, whereby the life of said electrode in said electrostatic precipitator is extended, and wherein one end of said flexible shroud extends into a recess formed in said anchoring element.

10. In an electrostatic precipitator comprising collector electrodes defining a plurality of gas passages therebetween and a high-voltage support frame adjacent the top of said collector electrodes from which a plurality of discharge electrodes are suspended beneath said frame in said gas passages between said collector electrodes, the improvement comprising at least the upper ends of said discharge electrodes being secured at respective anchoring elements, said discharge electrodes being suspended from said high-voltage support frame by said anchoring elements, wherein flexible shrouds as attachments over said elongated high-voltage discharge electrodes closely surround said elongated discharge electrodes adjacent said anchoring elements, whereby the life of said discharge electrodes in said electrostatic precipitator is extended.

11. The electrostatic precipitator according to claim 10, wherein said flexible shrouds each comprise a spring, which closely surrounds an elongated discharge electrode adjacent an anchoring element.

12. The electrostatic precipitator according to claim 11, wherein the spring of each flexible shroud is a closely coiled, cylindrical helical spring.

13. The electrostatic precipitator according to claim 10, wherein said flexible shrouds are secured to said elongated discharge electrodes adjacent the anchoring elements by crimped portions of the flexible shrouds which engage the electrodes.

14. In an electrostatic precipitator comprising collector electrodes defining a plurality of gas passages therebetween and a high-voltage support frame adjacent the top of said collector electrodes from which a plurality of discharge electrodes are suspended beneath said frame in said gas passages between said collector electrodes, the improvement comprising at least the upper ends of said discharge electrodes being secured at respective anchoring elements, said discharge electrodes being suspended from said high-voltage support frame by said anchoring elements, and wherein flexible shrouds closely surround said elongated discharge electrodes adjacent said anchoring elements, whereby the life of said discharge electrodes in said electrostatic precipitator is extended, and wherein the upper ends of said discharge electrodes extend through bores in said anchoring elements and are formed with enlarged, headed portions which secure the upper ends of the electrodes against axial displacement through the anchoring elements.

15. In an electrostatic precipitator comprising collector electrodes defining a plurality of gas passages therebetween and a high-voltage support frame adjacent the top of said collector electrodes from which a plurality of discharge electrodes are suspended beneath said frame in said gas passages between said collector electrodes, the improvement comprising at least the upper ends of said discharge electrodes being secured at respective anchoring elements, said discharge electrodes being suspended from said high-voltage support frame by said anchoring elements, and wherein flexible shrouds closely surround said elongated discharge electrodes adjacent said anchoring elements, whereby the life of said discharge electrodes in said electrostatic precipitator is extended and, wherein one end of each of said flexible shrouds extends into a recess formed in the adjacent anchoring element.

* * * * *